US012091932B2

(12) United States Patent
Lindahl et al.

(10) Patent No.: US 12,091,932 B2
(45) Date of Patent: Sep. 17, 2024

(54) DOWNHOLE MIXING OF WELLBORE TREATMENT FLUIDS

(71) Applicants: Saudi Arabian Oil Company, Dhahran (SA); Modern Ejada for Well Drilling, Thuwal (SA)

(72) Inventors: Carl D. Lindahl, Dhahran (SA); Mohammad Aljubran, Stanford, CA (US); Abdulwahab S. Aljohar, Dhahran (SA); Mohammed Alsheikh, Thuwal (SA); Shehab Ahmed, Thuwal (SA)

(73) Assignee: Saudi Arabian Oil Company, Dhahran (SA)

( * ) Notice: Subject to any disclaimer, the term of this patent is extended or adjusted under 35 U.S.C. 154(b) by 88 days.

(21) Appl. No.: 17/902,622

(22) Filed: Sep. 2, 2022

(65) Prior Publication Data

US 2024/0076951 A1 Mar. 7, 2024

(51) Int. Cl.
*E21B 33/16* (2006.01)
*E21B 33/12* (2006.01)

(52) U.S. Cl.
CPC ..... *E21B 33/16* (2013.01); *E21B 33/12* (2013.01)

(58) Field of Classification Search
CPC ..... E21B 33/16; E21B 33/12; E21B 17/14
See application file for complete search history.

(56) References Cited

U.S. PATENT DOCUMENTS 1,912,578 A * 6/1933 Halliburton ..... E21B 33/146 166/291
2,703,145 A * 3/1955 Hildebrandt ..... E21B 33/14 166/222
3,223,159 A * 12/1965 Brown ..... E21B 33/14 166/149
4,064,941 A 12/1977 Smith
4,427,070 A * 1/1984 O'Brien ..... E21B 34/14 166/317
4,469,174 A * 9/1984 Freeman ..... E21B 17/14 166/317
6,981,560 B2 * 1/2006 Nguyen ..... C09K 8/24 507/221
7,077,195 B2 * 7/2006 Zotta ..... E21D 21/0073 138/93
7,281,576 B2 * 10/2007 Curtice ..... E21B 33/13 166/250.14

(Continued)

*Primary Examiner* — Steven A MacDonald
(74) *Attorney, Agent, or Firm* — Fish & Richardson P.C.

(57) ABSTRACT

A wellbore assembly includes a wellbore string disposed within a wellbore and a cement retainer coupled to a downhole end of the wellbore string. The cement retainer includes a housing, a packer, a valve, and a sleeve. The housing includes one or more fluid ports extending from an interior surface of the housing to the annulus. The housing defines a first fluid pathway extending from within the wellbore string to within the housing. The sleeve is movable between a first position, in which the sleeve blocks the one or more fluid ports, and a second position in which the sleeve exposes the one or more fluid ports to open a second fluid pathway extending from the annulus, through the one or more fluid ports, to the first fluid pathway. Opening the second fluid pathway allows mixing of a first fluid with a second fluid in the cement retainer.

20 Claims, 4 Drawing Sheets

(56) References Cited

U.S. PATENT DOCUMENTS

| | | | | |
|---|---|---|---|---|
| 2002/0153142 | A1* | 10/2002 | Eslinger | E21B 33/124 166/305.1 |
| 2003/0196811 | A1* | 10/2003 | Crawford | E21B 17/203 166/300 |
| 2004/0118560 | A1* | 6/2004 | Johnson | E21B 33/14 166/285 |
| 2005/0199390 | A1* | 9/2005 | Curtice | E21B 33/13 166/250.14 |
| 2011/0030947 | A1* | 2/2011 | Schreiber | E21B 33/138 166/250.01 |
| 2013/0213646 | A1* | 8/2013 | Angman | E21B 43/14 166/184 |
| 2013/0277047 | A1* | 10/2013 | Kuhn de Chizelle | E21B 17/203 166/305.1 |
| 2021/0246759 | A1* | 8/2021 | Cao | E21B 21/10 |
| 2022/0268114 | A1* | 8/2022 | Egbe | E21B 34/103 |
| 2022/0275705 | A1* | 9/2022 | Egbe | E21B 17/18 |
| 2023/0070661 | A1* | 3/2023 | Kumar | E21B 17/14 |

* cited by examiner

DOWNHOLE MIXING OF WELLBORE TREATMENT FLUIDS

FIELD OF THE DISCLOSURE

This disclosure relates to wellbore equipment and operations, and more particularly to remedial equipment and operations.

BACKGROUND OF THE DISCLOSURE

Cementing operations and remedial operations can help prevent and address wellbore problems such as lost circulation or cementing issues. Lost circulation occurs when drilling fluid flows into one or more fractures of geological formations instead of returning up the annulus of the wellbore. The process of performing remedial cementing operations can be lengthy and present multiple challenges. Methods and equipment for improving cementing operations and remedial operations are sought.

SUMMARY

Implementations of the present disclosure include a wellbore assembly that includes a wellbore string disposed within a wellbore and a cement retainer coupled to a downhole end of the wellbore string. The cement retainer includes a housing, a packer, a valve, and a sleeve. The housing defines, with the cement retainer set on a wall of the wellbore, an annulus between an external surface of the housing and the wall of the wellbore. The housing includes one or more fluid ports extending from an interior surface of the housing to the annulus. The housing defines, with the wellbore string coupled to the housing, a first fluid pathway extending from within the wellbore string to within the housing. The packer sets the housing on the wall of the wellbore. The valve is disposed within the housing downhole of the one or more fluid ports. The valve regulates a flow of fluid across the cement retainer. The sleeve is disposed within the cement retainer uphole of the valve. The sleeve is movable between a first position, in which the sleeve blocks the one or more fluid ports, and a second position in which the sleeve exposes the one or more fluid ports to open a second fluid pathway extending from the annulus, through the one or more fluid ports, to the first fluid pathway. Opening the second fluid pathway allows, with the valve opened, mixing of a first fluid flowing along the first fluid pathway with a second fluid flowing from the second fluid pathway and allows flowing the first fluid and the second fluid out of the cement retainer.

In some implementations, the first fluid pathway extends from a terranean surface of the wellbore, through the wellbore string, to a bore of the housing, and the second fluid pathway extends from the terranean surface of the wellbore, through a wellbore annulus defined between the wellbore string and the wall of the wellbore, to the bore of the housing.

In some implementations, the wellbore string is configured to set the packer by at least one of mechanical motion of the wellbore string, hydraulic pressure applied from a terranean surface of the wellbore, or an electrical signal transmitted to the packer.

In some implementations, the wellbore string is configured to move the sleeve from the first position to the second position by pushing, with a downhole end of the wellbore string, the sleeve in a downhole direction. In some implementations, the valve includes one of a check valve or a flapper valve, and the wellbore string is configured to open the valve by stinging the valve with a stinger extending from the downhole end of the wellbore string. In some implementations, the wellbore string is configured to sting the valve before bushing the sleeve enough to open the second fluid pathway.

In some implementations, the first fluid includes a first lost circulation material and the second fluid includes a second lost circulation material, and the fluids mix at least partially inside the housing before exiting the housing and reaching a lost circulation zone of the wellbore downhole of the cement retainer. In some implementations, the packer is configured to isolate, with the packer set on the wall of the wellbore and the valve closed, the annulus from the lost circulation zone.

In some implementations, the wellbore assembly further includes a static mixer attached to a downhole end of the cement retainer and fluidly coupled to the cement retainer, the static mixer configured to receive the two fluids from the cement retainer and mix the two fluids within the static mixer before the two fluids exit the static mixer.

Implementations of the present disclosure include a wellbore tool that includes a housing and a gate. The housing is fluidly coupled to a wellbore string that is disposed within a wellbore. The housing defines, with the housing set on a wall of the wellbore, an annulus between the housing and the wall of the wellbore. The housing includes one or more fluid ports that extend through a wall of the housing. The housing defines, with the wellbore string coupled to the housing, a first fluid pathway extending from the wellbore string to the housing. The gate is disposed within the cement retainer and is movable between a first position, in which the gate blocks the one or more fluid ports, and a second position in which the gate exposes the one or more fluid ports to open a second fluid pathway extending from the annulus, through the one or more fluid ports, to within the housing to allow at least a partial mixing within the housing of a first fluid from the first fluid pathway with a second fluid from the second fluid pathway before the first fluid and the second fluid exit the housing.

In some implementations, the wellbore tool further includes a valve disposed within the housing downhole of the one or more fluid ports. The valve is configured to regulate a flow of fluid across the housing. The gate is movable to the second position to allow, with the valve opened, mixing of the first fluid flowing along the first fluid pathway with the second fluid flowing from the second fluid pathway and to allow flowing the first fluid and the second fluid out of the cement retainer.

In some implementations, the wellbore tool further includes a packer configured to expand to set the housing on the wall of the wellbore, the packer configured to isolate, with the packer set on the wall of the wellbore and the valve closed, the annulus from the lost circulation zone. In some implementations, the wellbore string is configured to set the packer by at least one of mechanical motion of the wellbore string, hydraulic pressure applied from a terranean surface of the wellbore, or an electrical signal transmitted to the packer.

In some implementations, the gate is moved by the wellbore string by moving the gate in a rotational or axial direction by a downhole end of the wellbore string. In some implementations, the valve is opened by the wellbore string stinging the valve with a stinger extending from the downhole end of the wellbore string.

In some implementations, the wellbore tool further includes a static mixer attached to a downhole end of the housing and fluidly coupled to the housing. The static mixer receives the two fluids from the housing and mix the two fluids within the static mixer before the two fluids exit the static mixer.

Implementations of the present disclosure include a method that includes setting a cement retainer on a wall of a wellbore. The cement retainer includes a housing defining an annulus between the housing and the wall of the wellbore. The housing includes one or more fluid ports extending through a wall of the housing. The cement retainer also includes a gate disposed within the cement retainer and movable between a first position, in which the gate blocks the one or more fluid ports, and a second position in which the gate exposes the one or more fluid ports. The cement retainer also includes a valve disposed within the housing downhole of the one or more fluid ports. The valve regulates a flow of fluid across the cement retainer. The method also includes fluidly coupling a wellbore string to the cement retainer to form a first fluid pathway extending from the wellbore string to the housing. The method also includes moving the gate from the first position to the second position to open a second fluid pathway extending from the annulus, through the one or more fluid ports, to within the housing. The method also includes opening the valve. The method also includes flowing a first fluid along the first fluid pathway. The method also includes flowing a second fluid along the second fluid pathway, thereby mixing the first fluid with the second fluid within the housing before the first fluid and the second fluid exit the housing.

In some implementations, setting the cement retainer includes setting, with the wellbore string, the cement retainer between 0 and 20 feet uphole of a lost circulation zone.

In some implementations, setting the cement retainer includes setting a packer of the cement retainer.

In some implementations, moving the gate includes moving the gate axially or rotationally with the wellbore string, and opening the gate includes stinging the gate with a stinger of the wellbore string.

DETAILED DESCRIPTION OF THE DISCLOSURE

The present disclosure relates to methods and equipment for performing remedial wellbore operations such as plugging operations, remedial cementing operations, and squeeze cementing operations. The wellbore assembly of the present disclosure includes a cement retainer that defines two fluid pathways, one along the bore and one along the annulus, that meet inside the cement retainer to mix two fluids in-situ for activation-timing purposes. While remedial cementing operations are the primary focus for this invention, it should not be limited to that scope as this system is capable of mixing any fluid treatment regime to be placed downhole, but without mixing and pumped from the surface of the wellbore.

Particular implementations of the subject matter described in this specification can be implemented so as to realize one or more of the following advantages. For example, the wellbore assembly of the present disclosure allows more effective plugging or cementing by allowing two or more fluids to be mixed near the area of interest.

Figure 1:
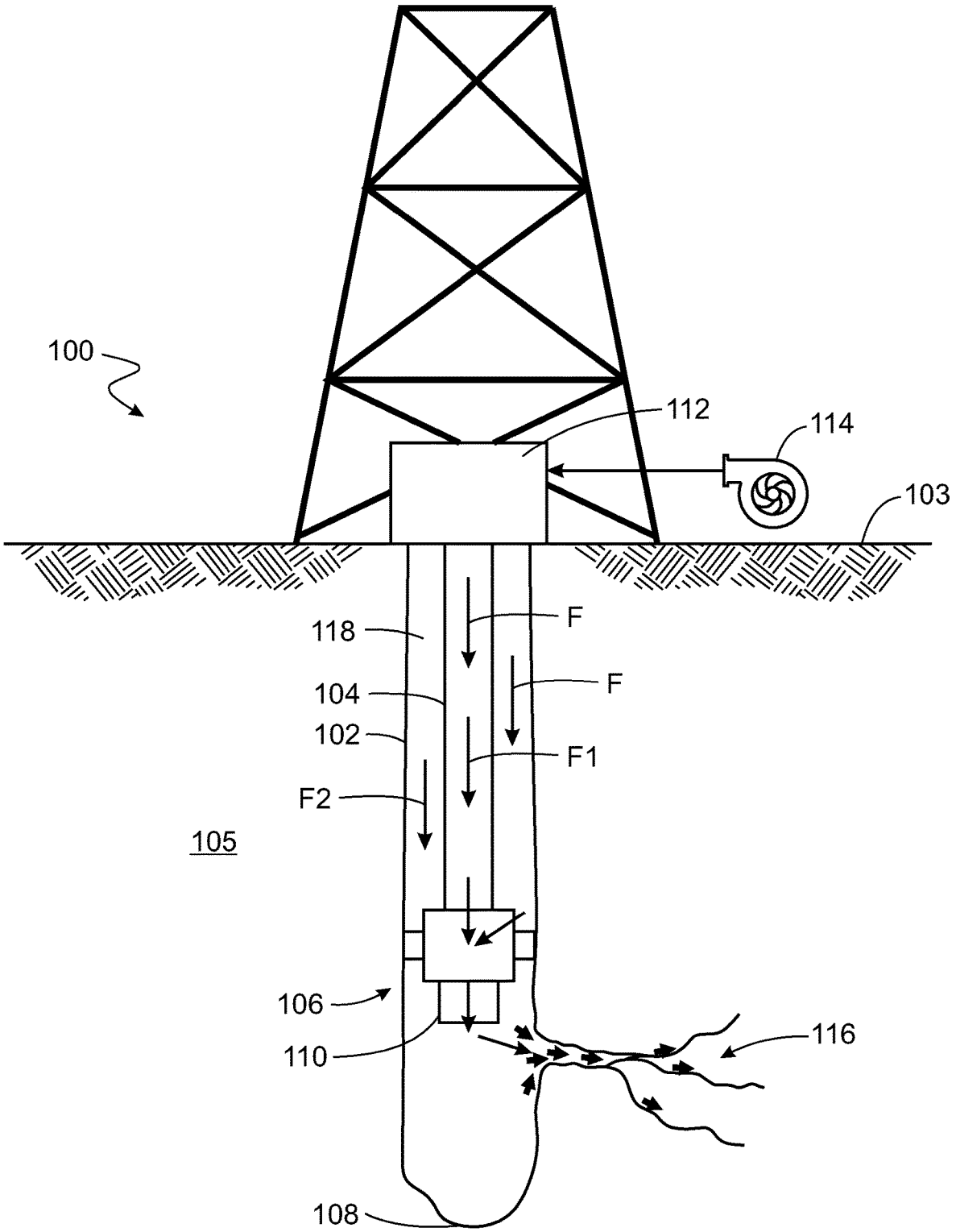
FIG. 1 is a schematic view, partially cross-sectional, of a wellbore assembly with a cement retainer disposed within a wellbore.

FIG. 1 shows a wellbore assembly 100 that includes a wellbore string 104 (e.g., a drill string, a work string, a wireline, a slickline, etc.) disposed within a wellbore 102. The wellbore assembly 100 also includes a cement retainer assembly 106 attached to a downhole end of the wellbore string 104. The wellbore string 104 can set the cement retainer assembly 106 on the wellbore and then flow a treatment fluid "F" (e.g., cement, lost circulation material, drilling fluid with lost circulation material, a sealant, etc.) to seal or plug the wellbore 102. In some implementations, the wellbore string 104 can set the cement retainer 106 on the wellbore 102 and a different wellbore string can flow the treatment fluids to perform the remedial or plugging operation. The wellbore 102 can have a lost circulation zone 116 through which circulation fluids are lost instead of returning to the surface of the wellbore. The cement retainer 106 can be used to plug the lost circulation zone 116.

The treatment fluid "F" can include one or more chemicals that solidify upon (or soon after) reacting. The treatment fluid "F" can also include cement, such as to treat a wellbore during total lost circulation. The lost circulation zone 116 can be, for example, a portion of the wellbore that has, for example, fractures, cracks, fissures, voids, or permeable rock.

The wellbore 102 (e.g., a vertical or non-vertical wellbore) is formed in a geologic formation 105. The geologic formation 105 can include a hydrocarbon reservoir from which hydrocarbons can be extracted. The wellbore 102 extends from a surface 103 (e.g., a terranean surface of the wellbore 102) to a downhole end 108 of the wellbore 102. The treatment fluid "F" is flown from the surface 103 to an outlet 110 of the cement retainer assembly. The wellbore string 104 can be attached to wellhead equipment 112 such as a rig, a wireline truck, a wellhead, etc.

The wellbore string 104 can be fluidly coupled to a surface pump 114 that flows the treatment fluid "F" through the wellbore string 104 to a loss circulation zone 116. As further described in detailed below with respect to FIGS. 1 and 2, the pump 114 flows two different treatment fluids "F1," "F2" down the wellbore to plug the wellbore. The two fluids can be mixed inside the cement retainer assembly 106. For example, a first treatment fluid "F1" can be flown downhole inside the wellbore string 104 and a second treatment fluid "F2" can be flown downhole through an annulus 118 defined between an external surface of the wellbore string and a wall of the wellbore 102. At the cement retainer assembly 106, the two fluids are mixed to flow downhole into the lost circulation zone 116.

Figure 2:
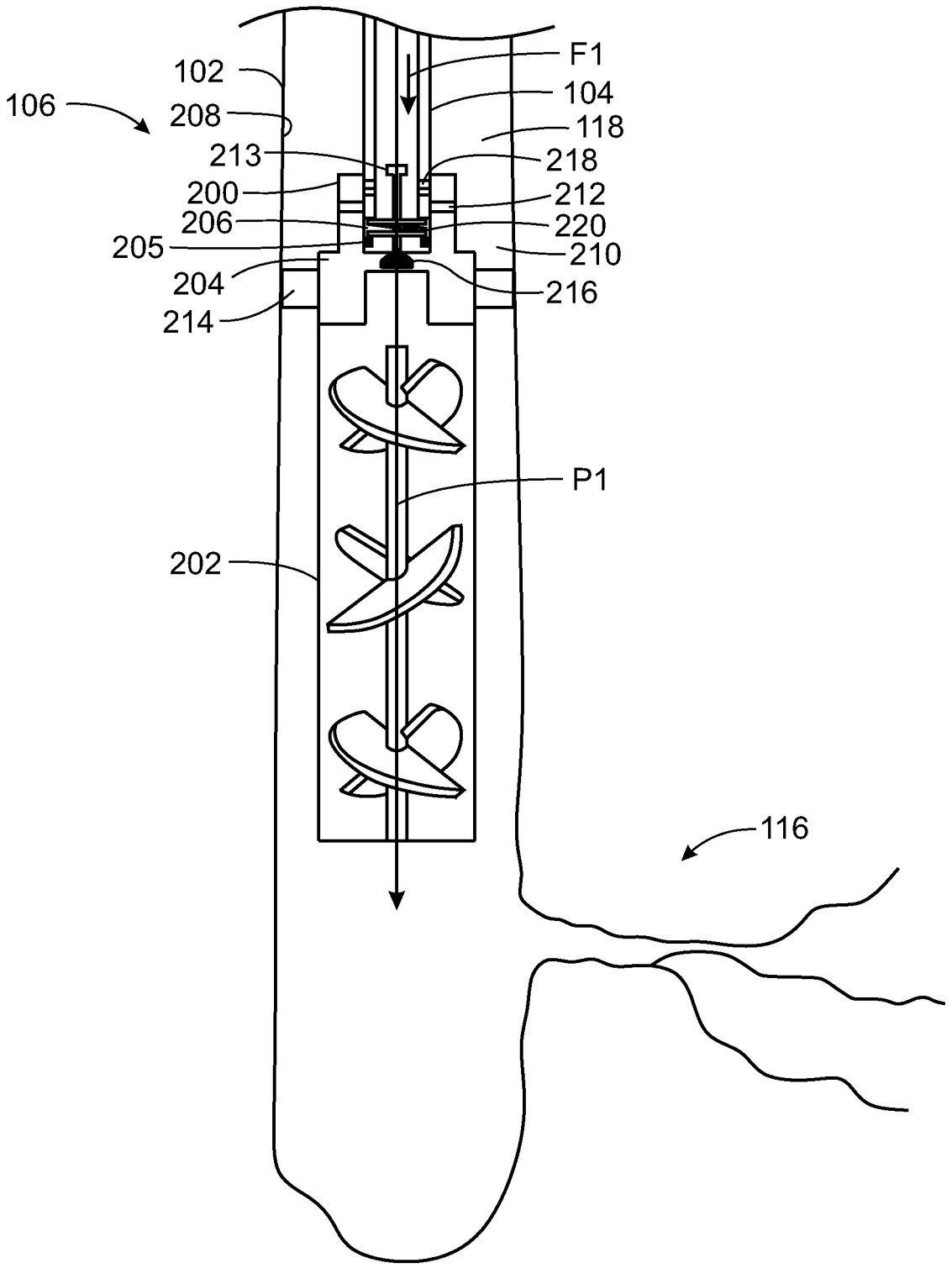
FIGS. 2-3 are front schematic views, partially cross-sectional, of sequential steps to plug a wellbore.

Referring now to FIG. 2, the cement retainer assembly 106 has a cement retainer 200 and a static mixer 202 attached to a downhole end of the cement retainer 200. The cement retainer 200 has a housing 204 that defines, with the cement retainer 200 set on the wall 208 (e.g., the interior surface of the wellbore casing) of the wellbore 102, an annulus 210 between an external surface of the housing 204 and the wall 208 of the wellbore 102. The annulus 210 can be the same as or be fluidly coupled to the annulus 118 defined by the wellbore string 104.

The housing 204 has a packer 214 that sets the housing 204 on the wall 208 of the wellbore 102. The packer 214 can be activated, for example, mechanically, hydraulically, or electrically. For example, the packer has expandable rubber elements that expand under fluidic pressure or by mechanical motion of the string 104 to set on the wall of the wellbore and isolate a section of the wellbore 102. The packer 214 isolates, with the packer 214 set on the wall of the wellbore 102, the annulus 118 from the lost circulation zone.

The cement retainer 200 has a valve 216 (e.g., a non-return valve such as a check valve or a flapper valve) disposed inside the housing 204 downhole of the one or more fluid ports 212. The valve regulates a flow of fluid across the cement retainer 200. For example, the valve 216 opens one way to allow fluid to flow downhole and not uphole (e.g., prevent backflow) through the cement retainer 200. The check valve can open when stung by a stinger of the wellbore string 104. The valve 216 controls the pressure uphole of the cement retainer 200 by preventing fluid (pressure) from entering up either the tubing or the annulus. Thus, the cement retainer 200 keeps the wellbore string safe in case of any "kick" or pressure spike occurrence during the operation.

The housing 204 defines a first fluid pathway "P 1" that extends, with the valve 216 opened, from within the wellbore string 104 (e.g., a wellbore string bore) through within the housing 204 (e.g., a housing bore), thought the static mixer 202, and out the outlet of the static mixer 202. With the valve 216 opened. The first fluid pathway "P 1" can extend from the terranean surface (e.g., from the surface inlet of the wellbore string 104) to the cement retainer assembly.

The housing 204 has one or more fluid ports 212 that extend from an interior surface 206 of the housing 204 to the annulus 210. The cement retainer 200 also has a gate or sleeve 218 disposed within the housing 204 uphole of the valve 216. The sleeve 218 has apertures that align with the fluid ports 212 to establish fluid communication with the annulus 118. The sleeve 218 can be a spring-loaded sleeve that has a spring 220 disposed between the sleeve 218 and a no-go profile 205 inside the housing 204.

Figure 3:
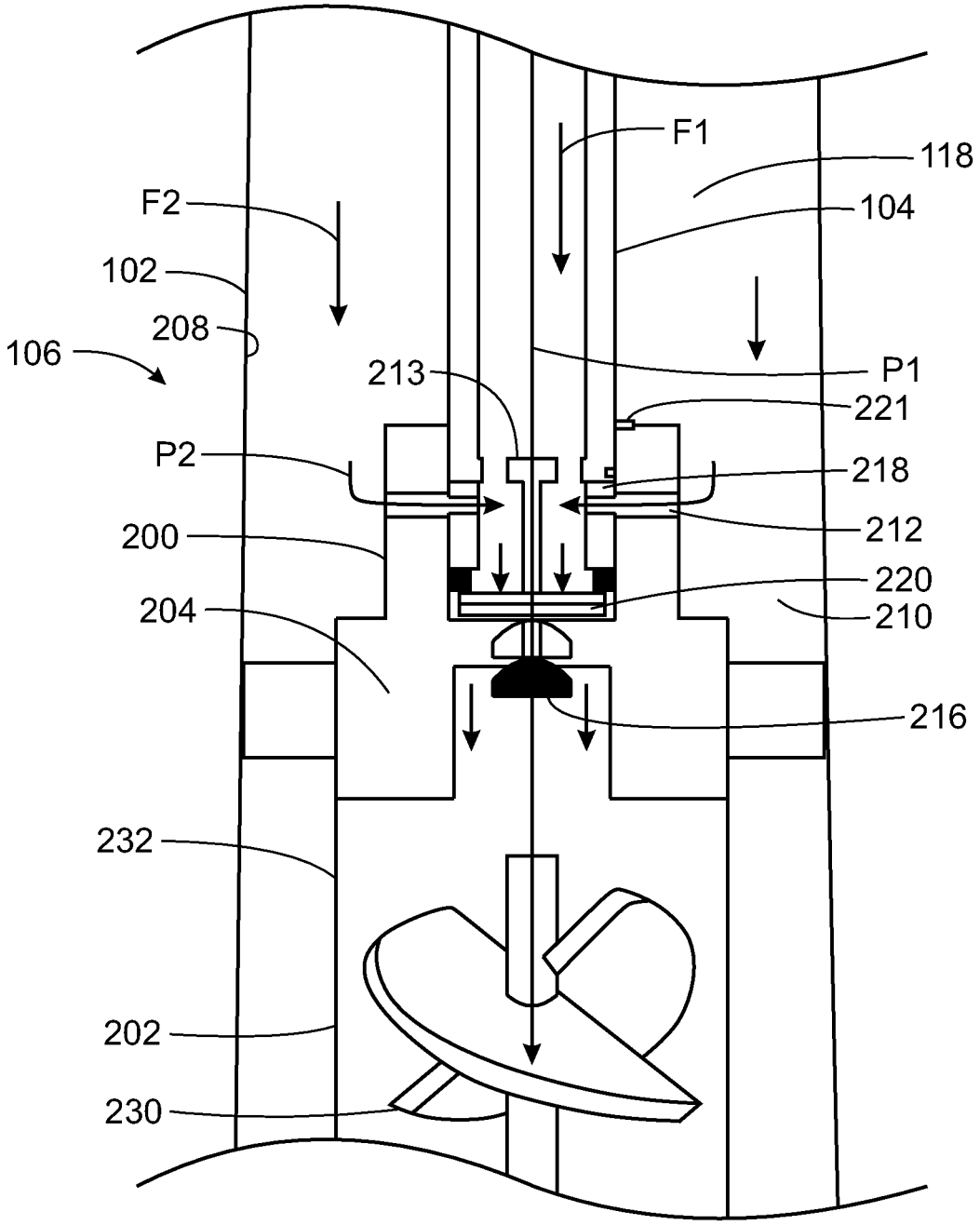

Referring also to FIG. 3, the sleeve 218 moves between a first position (as shown in FIG. 2), in which the sleeve 218 blocks or covers the one or more fluid ports 212, and a second position (as shown in FIG. 3), in which the sleeve 218 has been moved downhole to align its apertures with the fluid ports 212 and thus expose the one or more fluid ports 212 from inside the retainer 200 to open a second fluid pathway "P2." As shown in FIG. 3, the second fluid pathway "P2" extends from the annulus 210 through the fluid ports 212, to the first fluid pathway "P1." With the valve 216 opened, the first fluid "F1" flowing along the first fluid pathway "P1" mixes with the second fluid "F2" flowing from the second fluid pathway "P2." The mixture of the two fluids flows out of the cement retainer to the static mixer 202.

The second fluid pathway "P2" can extend from the terranean surface of the wellbore 102 (e.g., from the inlet of the annulus 118), through the wellbore annulus 118, through the housing annulus 210, through the fluid ports 212, and to within the housing 204.

In some implementations, treatment fluid "F1" can be flown only along the first fluid pathway "P1" to treat the wellbore. For example, a stinger 213 of the wellbore string 104 can push open the valve 216 without (i.e., before) opening the second fluid pathway. In some implementations, the treatment fluid "F1" can be directed to the lost circulation zone through one fluid pathway "P1," "P2" only. In some implementations, a treatment fluid can be first flown through one of the first and second fluid pathway and then another fluid can be flown through the other one of the first and second fluid pathway.

Referring to FIG. 3, the wellbore string 104 can be releasably attached (e.g., with shear pins 221) to the cement retainer 200. Once the cement retainer 200 is set, the wellbore string 104 is released from the cement retainer 200 (e.g., by breaking the shear pins 221) and then the same wellbore string 104 or a different wellbore string can sting the cement retainer 200 to open the valve 206 and the second fluid pathway "P2."

With the wellbore string 104 detached from the cement retainer 200, the wellbore string 104 can move the sleeve from the first position to the second position by pushing, with the end of the wellbore string, the sleeve 218 in a downhole direction to open the second fluid pathway "P2." In some implementations, the sleeve 218 can be rotationally attached to the housing, and the wellbore string 104 can move the sleeve 218 engaging and rotating the sleeve 218.

The downward movement of the wellbore string 104 also pushes the valve 216 open with the stinger 213 to allow the mixture of two treatment fluids "F1," "F2" to flow out of the cement retainer 200. The first fluid "F1" flows along the first fluid pathway "P1," and the second fluid "F2" flows along the second fluid pathway "P2" to mix with the first fluid "F1."

The stinger 213 can be an arm or tube that extends beyond the wellbore string. The stinger 213 extends, for example, from the downhole end (e.g., the outlet) of the wellbore string 104 or from within the bore of the wellbore string 104.

To treat the lost circulation zone and plug or fix the wellbore 102, two treatment fluids "F1," "F2" can be mixed in-situ. In other words, the treatment fluids can be mixed near or adjacent to the lost circulation zone to activate the fluids shortly before flowing the fluids to the lost circulation zone. For example, the timescale needed to activate or solidify the chemical mixture of the two fluids "F1," "F2" can be relatively short, which can cause the sealing operation to fail if the two fluids are mixed and flown from the surface of the wellbore 102. Activating the fluids in situ allows the treatment fluids to solidify at effectively at the lost circulation zone. The cement retainer assembly can be set, for example, between 0 and 5, or 0 and 10, or 0 and 20, or 0 and 50 feet uphole the lost circulation zone.

The two fluids "F1," "F2" can be or include cement or lost circulation materials. With the second fluid "F2" established, the two fluids "F1," "F2" mix at least partially inside the housing before exiting the housing. The mixture reaches the lost circulation zone of the wellbore just before or as the mixture sets and solidifies.

The static mixer 202 can have a fixed helix or tabs 230 inside a pipe or housing 232. The static mixer 202 is attached to a downhole end of the cement retainer 200. The static mixer 202 is fluidly coupled to the cement retainer 200 to receive the two fluids "F1," "F2" and further mix the fluids before the two fluids exit the static mixer. For example, the fluids can be partially mixed within the housing 204 and the fluids can be further (or fully) mixed in the static mixer 230.

Once the pumping of fluids "F1," "F2" is complete, the pipe is stung out, isolating the section of the wellbore uphole of the cement retainer 200 from the section of the wellbore downhole of the cement retainer 200. Isolating the pressure in the top zone can help reduce the hydrostatic pressure seen by the bottom zone. This reduces the risks of exceeding formation fracture pressure and inducing losses.

Figure 4:
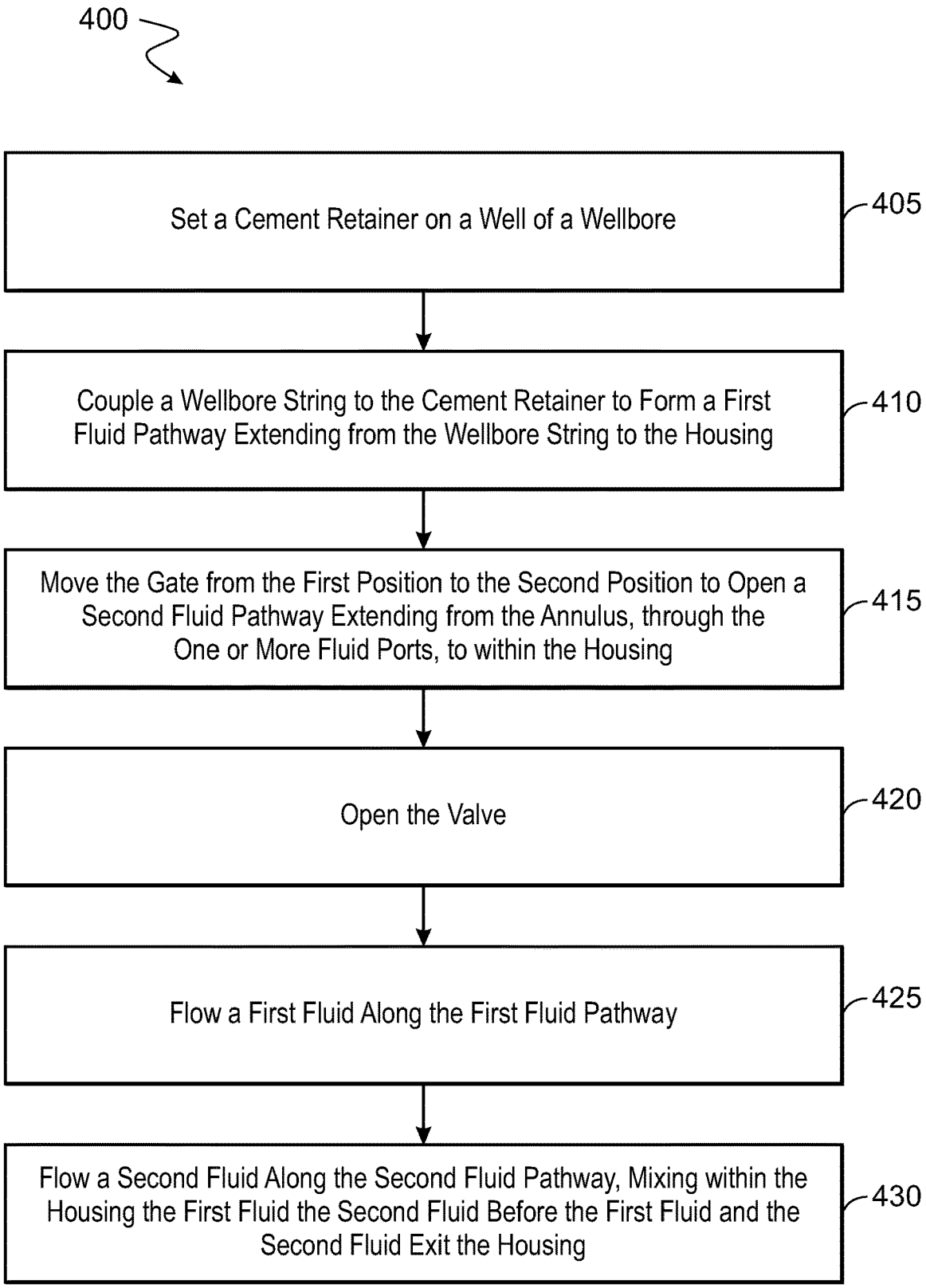
FIG. 4 is a flow chart of a method of plugging a wellbore.

FIG. 4 shows a flow chart of an example method 400 of plugging a wellbore. The method includes setting a cement retainer on a wall of a wellbore (405). The cement retainer includes a housing, a gate, and a valve. The housing defines an annulus between the housing and the wall of the wellbore.

The housing has one or more fluid ports that extend through a wall of the housing. The gate is disposed within the cement retainer and is movable between a first position, in which the gate blocks the one or more fluid ports, and a second position in which the gate exposes the one or more fluid ports. The valve is disposed within the housing downhole of the one or more fluid ports. The valve regulates a flow of fluid across the cement retainer. The method also includes fluidly coupling a wellbore string to the cement retainer to form a first fluid pathway extending from the wellbore string to the housing (410). The method also includes moving the gate from the first position to the second position to open a second fluid pathway extending from the annulus, through the one or more fluid ports, to within the housing (415). The method also includes opening the valve (420). The method also includes flowing a first fluid along the first fluid pathway (425). The method also includes flowing a second fluid along the second fluid pathway, mixing within the housing the first fluid the second fluid before the first fluid and the second fluid exit the housing (430).

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that the mere use of the term "first" and "second" does not require that there be any "third" component, although that possibility is contemplated under the scope of the present disclosure.

What is claimed is:

1. A wellbore assembly comprising:

a wellbore string configured to be disposed within a wellbore; and a cement retainer configured to be coupled to a downhole end of the wellbore string, the cement retainer comprising:

a housing defining, with the cement retainer set on a wall of the wellbore, an annulus between an external surface of the housing and the wall of the wellbore, the housing comprising one or more fluid ports extending from an interior surface of the housing to the annulus, the housing defining, with the wellbore string coupled to the housing, a first fluid pathway extending from within the wellbore string to within the housing;

a packer configured to set the housing on the wall of the wellbore;

a valve disposed within the housing downhole of the one or more fluid ports, the valve configured to regulate a flow of fluid across the cement retainer; and a sleeve disposed within the cement retainer uphole of the valve, the sleeve movable between a first position, in which the sleeve blocks the one or more fluid ports, and a second position in which the sleeve exposes the one or more fluid ports to open a second fluid pathway extending from the annulus, through the one or more fluid ports, to the first fluid pathway to allow, with the valve opened, mixing of a first fluid flowing along the first fluid pathway with a second fluid flowing from the second fluid pathway and flowing the first fluid and the second fluid out of the cement retainer.

2. The wellbore assembly of claim 1, wherein the first fluid pathway extends from a terranean surface of the wellbore, through the wellbore string, to a bore of the housing, and the second fluid pathway extends from the terranean surface of the wellbore, through a wellbore annulus defined between the wellbore string and the wall of the wellbore, to the bore of the housing.

3. The wellbore assembly of claim 1, wherein the wellbore string is configured to set the packer by at least one of mechanical motion of the wellbore string, hydraulic pressure applied from a terranean surface of the wellbore, or an electrical signal transmitted to the packer.

4. The wellbore assembly of claim 1, wherein the wellbore string is configured to move the sleeve from the first position to the second position by pushing, with a downhole end of the wellbore string, the sleeve in a downhole direction.

5. The wellbore assembly of claim 4, wherein the valve comprises one of a check valve or a flapper valve, and the wellbore string is configured to open the valve by stinging the valve with a stinger extending from the downhole end of the wellbore string.

6. The wellbore assembly of claim 5, wherein the wellbore string is configured to sting the valve before pushing the sleeve enough to open the second fluid pathway.

7. The wellbore assembly of claim 1, wherein the the wellbore assembly is configured to mix the first fluid with the second fluid inside the housing before the fluids exit the housing and reach a lost circulation zone of the wellbore downhole of the cement retainer.

8. The wellbore assembly of claim 7, wherein the packer is configured to isolate, with the packer set on the wall of the wellbore and the valve closed, the annulus from the lost circulation zone.

9. The wellbore assembly of claim 1, further comprising a static mixer attached to a downhole end of the cement retainer and fluidly coupled to the cement retainer, the static mixer configured to receive the two fluids from the cement retainer and mix the two fluids within the static mixer before the two fluids exit the static mixer.

10. A wellbore tool, comprising:

a housing configured to be fluidly coupled to a wellbore string configured to be disposed within a wellbore, the housing comprising a fluid outlet at a downhole end of the hosing, the housing defining, with the housing set on a wall of the wellbore, an annulus between the housing and the wall of the wellbore, the housing comprising one or more fluid ports extending through a wall of the housing, the housing defining, with the wellbore string coupled to the housing, a first fluid pathway extending from the wellbore string to the housing;

a packer coupled to the housing configured to expand to set the housing on the wall of the wellbore; and a gate disposed within the housing and movable between a first position, in which the gate blocks the one or more fluid ports, and a second position in which the gate exposes the one or more fluid ports to open a second fluid pathway extending from the annulus, through the one or more fluid ports, to within the housing to allow at least a partial mixing within the housing of a first fluid from the first fluid pathway with a second fluid from the second fluid pathway before the first fluid and the second fluid exit the housing through the fluid outlet.

11. The wellbore tool of claim 10, further comprising a valve disposed within the housing downhole of the one or more fluid ports, the valve configured to regulate a flow of fluid across the housing, and wherein the gate is movable to the second position to allow, with the valve opened, mixing of the first fluid flowing along the first fluid pathway with the second fluid flowing from the second fluid pathway and to allow flowing the first fluid and the second fluid out of the cement retainer.

12. The wellbore tool of claim 10, wherein the packer is configured to isolate, with the packer set on the wall of the wellbore and the valve closed, the annulus from a lost circulation zone downhole of the packer.

13. The wellbore tool of claim 12, wherein the packer is configured to be set by the wellbore string by at least one of mechanical motion of the wellbore string, hydraulic pressure applied from a terranean surface of the wellbore, or an electrical signal transmitted to the packer.

14. The wellbore tool of claim 10, wherein the gate is configured to be moved by the wellbore string in a rotational or axial direction by a downhole end of the wellbore string.

15. The wellbore tool of claim 14, wherein the valve is configured to be opened by the wellbore string stinging the valve with a stinger extending from the downhole end of the wellbore string.

16. The wellbore tool of claim 10, further comprising a static mixer attached to a downhole end of the housing and fluidly coupled to the housing, the static mixer configured to receive the two fluids from the housing and mix the two fluids within the static mixer before the two fluids exit the static mixer.

17. A method comprising:

setting a cement retainer on a wall of a wellbore, the cement retainer comprising:

a housing defining an annulus between the housing and the wall of the wellbore, the housing comprising one or more fluid ports extending through a wall of the housing, a gate disposed within the cement retainer and movable between a first position, in which the gate blocks the one or more fluid ports, and a second position in which the gate exposes the one or more fluid ports, and a valve disposed within the housing downhole of the one or more fluid ports, the valve configured to regulate a flow of fluid across the cement retainer;

fluidly coupling a wellbore string to the cement retainer to form a first fluid pathway extending from the wellbore string to the housing;

moving the gate from the first position to the second position to open a second fluid pathway extending from the annulus, through the one or more fluid ports, to within the housing;

opening the valve;

flowing a first fluid along the first fluid pathway; and flowing a second fluid along the second fluid pathway, mixing within the housing the first fluid the second fluid before the first fluid and the second fluid exit the housing.

18. The method of claim 17, wherein setting the cement retainer comprises setting, with the wellbore string, the cement retainer between 0 and 20 feet uphole of a lost circulation zone.

19. The method of claim 17, wherein setting the cement retainer comprises setting a packer of the cement retainer.

20. The method of claim 17, wherein moving the gate comprises moving the gate axially or rotationally with the wellbore string, and opening the valve comprises stinging the valve with a stinger of the wellbore string.

* * * * *